United States Patent [19]

Pasik

[11] 4,209,730

[45] Jun. 24, 1980

[54] STARTING CIRCUIT FOR GASEOUS DISCHARGE LAMPS

[75] Inventor: John J. Pasik, Romeoville, Ill.

[73] Assignee: Larry McGee Company, Chicago, Ill.

[21] Appl. No.: 924,509

[22] Filed: Jul. 14, 1978

[51] Int. Cl.[2] ..... H05B 41/16; H05B 41/04

[52] U.S. Cl. ..... 315/290; 315/205; 315/244

[58] Field of Search ..... 315/205, 239, 240, 244, 315/289, 290, DIG. 2, DIG. 5, DIG. 7

[56] References Cited

U.S. PATENT DOCUMENTS

| | | | |
|---|---|---|---|
| 3,771,014 | 11/1973 | Paget | 315/205 X |
| 3,889,152 | 6/1975 | Bodine, Jr. et al. | 315/205 |
| 3,917,976 | 11/1975 | Nuckolls | 315/240 X |
| 3,976,910 | 8/1976 | Owens et al. | 315/DIG. 5 |
| 4,072,878 | 2/1978 | Engel et al. | 315/205 |
| 4,107,579 | 8/1978 | Bodine, Jr. | 315/205 |

*Primary Examiner*—Eugene R. LaRoche

*Attorney, Agent, or Firm*—McDougall, Hersh & Scott

[57] ABSTRACT

A starting circuit suitable for sodium vapor street lamps is disclosed. The circuit includes a voltage doubler which periodically fires pulses through the lamp ballast. The pulsing is controlled by a neon lamp connected to a gate anode of a triac. When the triac fires the capacitors which form the voltage doubler are shorted across to produce the starting pulse.

10 Claims, 5 Drawing Figures

STARTING CIRCUIT FOR GASEOUS DISCHARGE LAMPS

BACKGROUND OF THE INVENTION

This invention relates to the field of lamp starting circuits. More specifically, it relates to circuits designed for initiating operation of gaseous discharge lamps such as the sodium vapor type commonly employed for street lighting. Such lamps require high voltage starting pulses in order to initiate the ionization process. Subsequent operation of the lamps is maintained by a large ballast connected in series with the AC voltage source.

Lamp starting circuits are known in the art and see, for example, the patents discussed in the prior art statement which follows. A principal drawback of the prior art is the inability of these designs to protect the starting circuit from premature failure where the lamp or power factor capacitor fails. Under those conditions the starting circuit repeatedly fires in an effort to light the lamp and in many cases this causes overheating of the starting circuit leading to premature component failure.

Another disadvantage of the existing circuits is that in order to prevent current flow through the trigger circuit isolation components are required as, for example, the use of an inductance which has a high impedance at the pulse frequency. Also, presently available circuits do not provide means whereby a service technician can rapidly check and service a lamp which is not properly operating. Instead, the technician must check each component of the operating circuit, the starting circuit and the lamp until he determines the source of the problem. It would be desirable to provide a starting circuit which includes indicator means permitting the technician to rapidly determine the source of a lamp failure thereby to quickly affect repair or replacement.

It is accordingly an oject of the present invention to provide an improved lamp starting circuit in which the starting circuit components are not subject to premature failure in the event that the lamp or an associated component fails thereby inducing repeated starting pulses.

Another object of the invention is to provide an improved starting circuit in which current does not pass through the circuit after the starting pulse has been produced until the circuit resets itself and is ready to begin recharging.

A further object of the invention is to provide a starting circuit embodiment in which high impedance isolating components are not required to protect the circuit against the high voltage pulses produced.

A further object of the invention is to provide a starting circuit which includes indicator means permitting a technician to rapidly determine whether the starting circuit is performing satisfactorily or is defective.

Other objects and advantages of the invention will be apparent from the remaining portion of the specification.

PRIOR ART STATEMENT

In accordance with the provisions of 37 CFR Section 1.97, applicant submits the following U.S. patents as the closest prior art of which he is aware: Nuckolls U.S. Pat. No. 3,917,976, Owens et al U.S. Pat. No. 3,976,910, Engel et al U.S. Pat. No. 4,072,878, and Bodine et al U.S. Pat. No. 3,889,152.

Nuckolls discloses two starting circuits both of which employ a capacitor discharged by means of a switch through a portion of the lamp ballast. In one embodiment the switch is a neon tube while in the other embodiment a triac is employed. An inductor and load resistor are placed in series across the lamp, the latter acting as a high impedance at the starting pulse frequency. Owens et al discloses a starting circuit in which a capacitor is charged up after a triac is fired, the starting pulse being produced during charging of the capacitor through the lamp ballast. Engel et al discloses as prior art a circuit similar to Nuckolls in which a capacitor is discharged through the ballast when a neon tube triggers an SCR. Bodine et al is also similar to Nuckolls and fires a capacitor through the large ballast when a diac triggers SCR 21.

DETAILED DESCRIPTION

Figure 1:
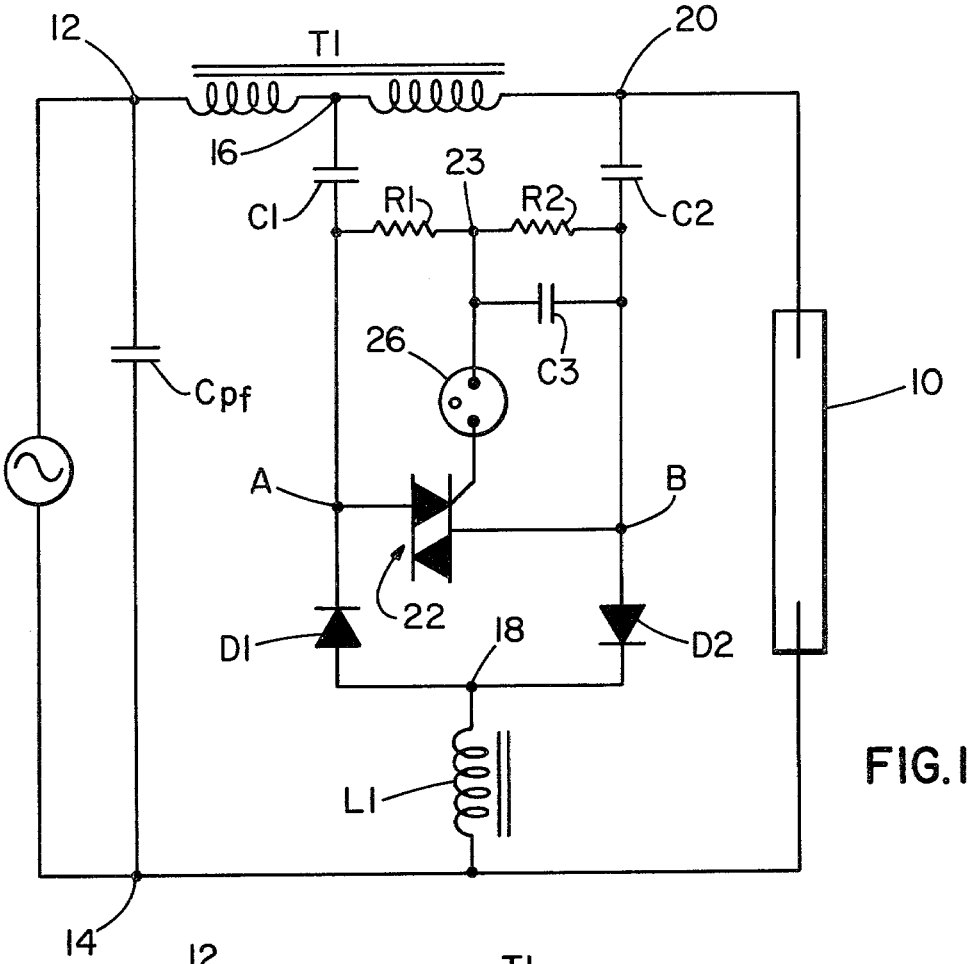
FIG. 1 discloses a first embodiment of the starting circuit according to the invention.

Referring to FIG. 1, a circuit according to a first embodiment of the invention is illustrated. The starting circuit is arranged to be connected in circuit with the standard lamp components found in a typical streetlight assembly. Thus, a gaseous discharge lamp 10 which may be of sodium vapor or other similar type is provided with a ballast transformer T1 and a power factor capacitor $C_{pf}$. A standard 115 volt AC power source is connected across supply terminals 12 and 14 and in the operating state of the lamp provide the current for its illumination. The starting circuit includes a pair of capacitors C1 and C2 and diodes D1 and D2. Capacitor C1 is in series with diode D1 between center top terminal 16 and terminal 18. Similarly, capacitor C2 is in series with diode D2 between terminal 18 and lamp terminal 20. Terminal 18 is connected to terminal 14, according to the first embodiment, by means of an inductor L1. The network thus far described constitutes a voltage doubler circuit and the operation of this portion of the circuit will be described with reference to FIG. 2.

Connected in shorting relation across one side of the capacitors C1 and C2 is a triac 22 including a gate or control electrode 24. Also connected across the capacitors is an RC network including resistors R1 and R2 which form a voltage divider and a capacitor C3 connected to the mid-point 23 of the resistors and to one of capacitors C1 or C2. Also connected to the midpoint 23 of the voltage divider is one electrode neon bulb 26. The other electrode of the neon bulb is connected to the triac gate 24 as illustrated. The components just described form the trigger circuit effective for firing a pulse from the voltage doubler through the transformer T1 to initiate operation of the lamp 10. The operation of the trigger circuit is described in connection with FIG. 3.

Figure 2:
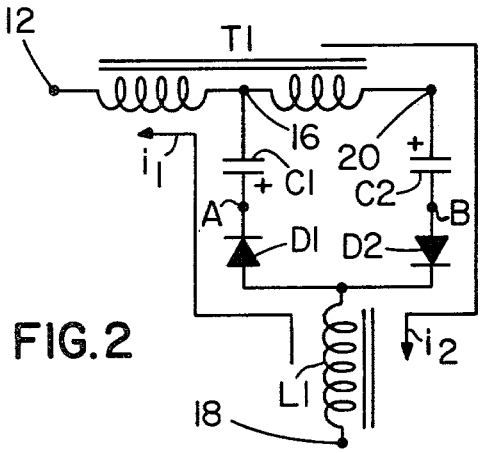
FIG. 2 discloses the voltage doubler circuit forming a portion of the FIG. 1 circuit.

Referring now to FIG. 2, the operation of the voltage doubler will be described. When power is applied to terminals 12 and 14 the AC input, during one half of the power waveform, will be negative with respect to terminal 14. C1 will then charge up to approximately the line voltage through the inductor L1, diode D1 and the portion of the transformer T1 located between terminals 12 and 16. The charging path is indicated in FIG. 2 and designated $i_1$. During the second half of the AC waveform terminal 12 will be positive with respect to terminal 14 and capacitor C2 similarly charges up to the AC line voltage through transformer T1, diode D2 and L1. This charging path is indicated in FIG. 2 and designated $i_2$.

After one cycle of the AC voltage there exists a voltage of two times the line voltage between the points designated A and B in FIG. 2. The trigger circuit to be described presently to effective for shorting points A and B together to produce a starting pulse which is applied through the transformer T1 to initiate operation of the lamp 10.

Figure 3:
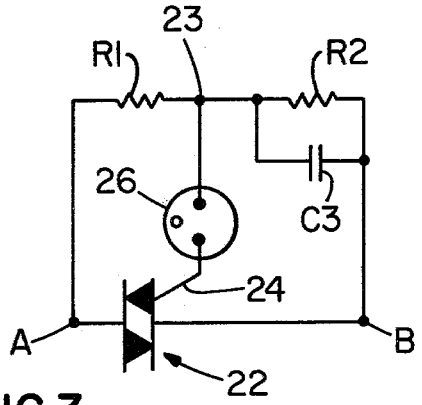
FIG. 3 discloses the trigger circuit of the FIG. 1 embodiment.

Referring to FIG. 3, the trigger circuit operates in the following manner. After capacitors C1 and C2 have been charged up so that a voltage of two times the line voltage exists between points A and B, capacitor C3 begins charging since it is connected between point B and the mid-point 23 of the voltage divider formed by resistors R1 and R2. When capacitor C3 has charged to a voltage equal to or exceeding the ionizing potential of neon lamp 26 flash-over occurs and the lamp conducts discharging capacitor C3 into the gate 24 of the triac 22. This turns the triac on shorting points A and B together producing the desired starting pulse through the center top terminal 16 and the portion of the ballast between terminals 16 and 20. At the point of the flash-over the neon lamp provides a visual indication of proper trigger circuit operation which can be readily viewed by a service technician in the event of a lamp malfunction. After the starting pulse has been produced and applied to the lamp the neon bulb ceases conduction terminating the trigger operation.

A principal advantage of the present invention is the manner of producing the pulse as compared with the prior art. The present invention, by shorting the capacitors in the voltage doubler circuit, produces a voltage pulse applied through a portion of the lamp ballast T1 to the lamp. Because the capacitors are shorted across, however, the circuit can draw no additional current through the trigger circuit as long as the triac is conducting. This feature is important in the case where a lamp is defective or the power factor capacitor $C_{pf}$ has failed. In prior art circuits these conditions often lead to premature failure of the starting circuit because the current passing through the starting circuit during its repeated operation when the lamp does not light causes overheating. The present invention, however, avoids this heating and premature failure because of the unique construction which prevents current flow through the starting circuit during triac conduction thereby eliminating the need for the series resistor present in the prior art circuits.

As indicated previously, the inductor L1 is connected between terminals 18 and 14 to present a high impedance to the short duration high voltage pulse produced when the trigger circuit fires. This keeps the high voltage pulse from getting into the charging circuit.

Figure 4:
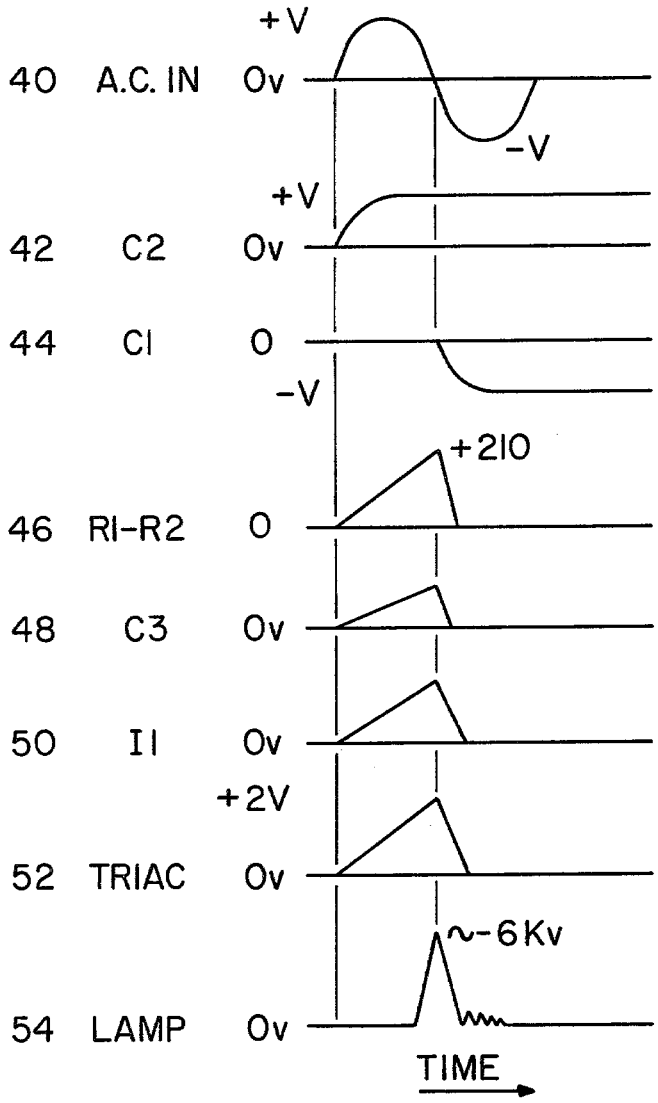
FIG. 4 is a waveform diagram useful in understanding the operation of the circuit.

Referring now to FIG. 4, various waveforms produced by the circuit and useful in understanding the operation thereof are illustrated. The AC input applied to terminals 12 and 14 is illustrated as waveform 40. The voltages obtained on the capacitor C1 and C2 after one cycle of AC operation are illustrated as waveforms 42 and 44. From these waveforms it can be seen that at points A and B a voltage exists which is two times the input voltage.

Waveform 46 illustrates the time varying voltage at the mid-point 23 of the voltage divider formed by resistors R1 and R2. Waveform 48 shows the manner in which capacitor C3 charges to a voltage sufficient to cause ignition of the neon tube 26. At the point of flash-over the voltage on the capacitor and the neon tube (waveform 50) rapidly returns to zero as the capacitor discharges into the gate electrode of the triac. Waveform 52 indicates that the voltage between points A and B prior to firing the triac is approximately twice the line voltage and subsequent to the triac firing rapidly drops to zero as the points are shorted together. Waveform 54 is an approximation of the high voltage pulse, usually on the order of six KV, produced when the triac shorts the capacitor and the pulse passes through a portion of the auto transformer T1.

Figure 5:
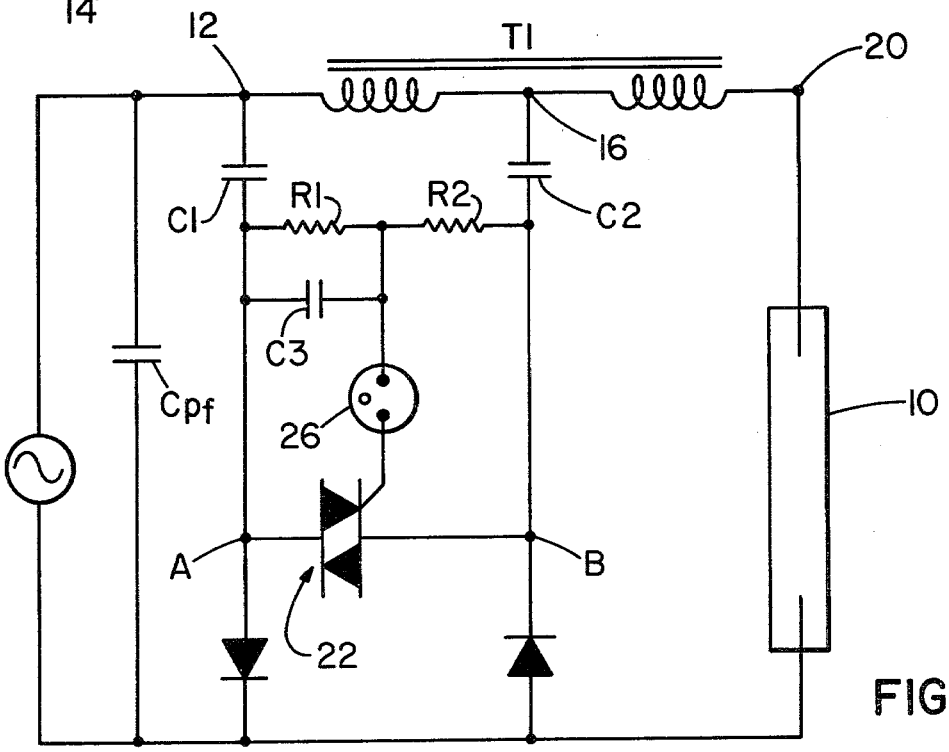
FIG. 5 is a second and preferred embodiment of the invention.

The circuit of FIG. 1 is advantageous in those situations where it is desired to make the starting circuit compatible with existing lighting installations which permit connections to the lamp and the lamp ballast only at specified locations. The circuit of FIG. 5 is preferred in those instances where new installations are being contemplated and will now be explained. The circuit of FIG. 5 is substantially identical to the FIG. 1 circuit. However, the inductor L1 has been eliminated and the charging and trigger portions of the circuit are connected across terminals 12 and 16 of the transformer T1 rather than terminals 16 and 20 as was the case in the first embodiment. In all other respects the structure of the circuit is the same as the first embodiment. The inductor L1 is omitted because the high voltage pulse cannot enter the charging circuit as was the case in the first embodiment as may be seen by tracing the discharging path through the circuit. When the triac fires the capacitors discharge through terminal 12 and the ballast portion between terminals 12 and 16. This, in turn, induces a high voltage pulse in the ballast portion between terminals 16 and 20 which pulse is applied to the lamp. The high voltage pulse cannot enter the charging circuit since the circuit is no longer connected in the pulsing path as was the case in the first embodiment where capacitor C2 and diode D2 are connected in series across terminals 18 and 20.

A principal feature of the invention is the ability of a technician to rapidly determine the source of a lamp malfunction. This is possible by virtue of the use of the neon lamp as part of the trigger circuit. In order to test the starter circuit the sodium vapor lamp is merely unscrewed from its socket. If the neon lamp flashes it is an indication that the voltage doubler circuit of FIG. 2 is properly functioning, that the ballast T1 is receiving power and that the triac is triggering. When a functioning lamp is screwed into the socket an arc in the lamp will indicate that high voltage is reaching the lamp. When the lamp starts drawing current triggering will cease and the neon lamp will cease firing. If the power factor capacitor is bad, this condition is indicated by firing of the neon lamp, and an arc in a functioning sodium lamp but with no tendency for the lamp to start drawing current. This last condition is one which frequently causes failure in the prior art circuits because of DC continuity and the excessive duty cycle which exists causing excessive heating of the starting circuit components.

By contrast, the present invention's voltage doubler, once the capacitors are shorted across, draws no additional current until the supply voltage again passes through zero and the trigger circuit resets. This eliminates the need for a load resistor present in the prior art circuits and the possibility of the resistor failing due to the high duty cycle which occurs when a bulb fails to light and the starting circuit repeatedly fires over a long period of time. In a typical circuit, such as shown in FIG. 1, the components will have the following values or be of the following types:

Diodes—1N4004
C1, C2—0.22mfd
C3—0.047mfd
R1, R2—1Mohm
L1—2.12mh

While I have shown and described embodiments of this invention in some detail, it will be understood that this description and illustrations are offered merely by way of example, and that the invention is to be limited in scope only by the appended claims.

I claim:

1. A starting circuit for gaseous discharge lamps having associated therewith a lamp ballast in series between a voltage supply and said lamp, said starting circuit comprising:
(a) a voltage doubler circuit connected in circuit with said ballast and said lamp for storing a voltage approximately twice the peak value of the voltage supply when said lamp is nonconducting, said voltage doubler including:
(i) a first circuit arm having a capacitor and diode in series, said diode conducting in a first direction,
(ii) a second circuit arm having a capacitor and diode in series, said diode conducting in the opposite direction to the first diode,
(iii) said first and second circuit arms being connected to the supply voltage at their diode ends and connected to the ballast at their capacitor ends,
whereby one of said capacitors will charge to the value of said voltage supply during each half cycle of the AC supply voltage,
(b) trigger means connected in shorting relation across said voltage doubler for selectively discharging the charge stored in said doubler circuit through a portion of said ballast to produce a high voltage starting pulse to initiate conduction in said lamp.

2. The starting circuit according to claim 1 wherein said starting circuit includes impedance means for preventing the high voltage pulse from getting into the starting circuit.

3. The starting circuit according to claim 1 wherein said voltage doubler is connected to the high voltage portion of the lamp ballast.

4. The starting circuit according to claim 3 wherein said starting circuit includes impedance means for preventing the high voltage pulse from getting into the starting circuit.

5. The starting circuit according to claim 1 wherein said ballast is an auto transformer and said voltage doubler is connected to said ballast between the supply terminal and the center tap terminal of said ballast, whereby the starting circuit is not present in the high voltage pulse path and impedance means is not required to protect the starting circuit against damage.

6. The starting circuit according to claim 1 wherein said trigger means includes means for visually observing when triggering occurs.

7. The starting circuit according to claim 1 wherein said trigger means is connected to the mid-point of the capacitor and diode in each of said first and second circuit arms, and triggering is effective for shorting the mid-points together to place said capacitors in series to produce said high voltage pulse through said ballast.

8. The starting circuit according to claim 1 wherein said trigger means includes:
(a) an RC timing network,
(b) a triac having a gate electrode,
(c) a neon tube connected between said RC network and the gate electrode of said triac,
whereby the triac is operated to short said voltage doubler and produce said high voltage pulse when the RC network charges up to the flash-over value of the neon tube thereby enabling the triac and visually signalling that triggering has occurred.

9. A starting circuit for gaseous discharge lamps having associated therewith a lamp ballast in series between said lamp and a voltage supply, said circuit comprising:
(a) a voltage doubling circuit including:
(i) a first circuit arm having a capacitor and diode in series, said diode conducting in a first direction,
(ii) a second circuit arm having a capacitor and diode in series, said diode conducting in the opposite direction to the first diode, said first and second circuit arms being connected to the supply voltage at their diode ends and connected to the ballast at their capacitor ends,
(b) trigger means for discharging said doubler circuit through a portion of said ballast to produce a high voltage starting pulse connected to the mid-point of the capacitor and diode in each of said first and second circuit arms, and triggering is effective for shorting the mid-points together to place said capacitors in series to produce said high voltage pulse through said ballast.

10. The starting circuit according to claim 9 wherein said trigger means includes:
(a) an RC timing circuit,
(b) a triac having a gate electrode,
(c) a neon tube connected between said RC network and the gate electrode of said triac,
whereby the triac is operated to short said voltage doubler and produce said high voltage pulse when the RC network charges up to the flash-over value of the neon tube thereby enabling the triac and visually signalling that triggering has occurred.

* * * * *